US010927717B2

(12) United States Patent
Raab et al.

(10) Patent No.: US 10,927,717 B2
(45) Date of Patent: Feb. 23, 2021

(54) VALVE TRAIN LEVER

(71) Applicant: MAN Truck & Bus Österreich GesmbH, Steyr (AT)

(72) Inventors: Gottfried Raab, Perg (AT); Thomas Eibl, Seitenstetten (AT); Franz Leitenmayr, Perg (AT); Ewald Hundsberger, Aschach/Steyr (AT)

(73) Assignee: MAN TRUCK & BUS ÖSTERREICH GESMBH, Steyr (AT)

( * ) Notice: Subject to any disclaimer, the term of this patent is extended or adjusted under 35 U.S.C. 154(b) by 0 days.

(21) Appl. No.: 15/974,038

(22) Filed: May 8, 2018

(65) Prior Publication Data

US 2018/0320563 A1 Nov. 8, 2018

(30) Foreign Application Priority Data

May 8, 2017 (AT) ..... 187/2017

(51) Int. Cl.
*F01L 1/24* (2006.01)
*F01L 13/00* (2006.01)
*F01L 1/18* (2006.01)

(52) U.S. Cl.
CPC ..... *F01L 1/2416* (2013.01); *F01L 1/181* (2013.01); *F01L 13/0005* (2013.01); *F01L 2001/186* (2013.01); *F01L 2001/2444* (2013.01); *F01L 2305/00* (2020.05); *F01L 2810/04* (2013.01); *F01L 2820/031* (2013.01)

(58) Field of Classification Search
CPC ..... F01L 1/2416; F01L 1/181; F01L 13/0005; F01L 2810/04; F01L 2105/00; F01L 2001/186; F01L 2820/031; F01L 2001/2444; F01L 1/24; F01L 1/18
USPC ..... 123/90.16, 90.39
See application file for complete search history.

(56) References Cited

U.S. PATENT DOCUMENTS 2,047,446 A * 7/1936 Taylor ..... F01L 1/146 123/90.22
4,192,263 A * 3/1980 Kitagawa ..... F01L 1/16 123/90.36
4,556,025 A * 12/1985 Morita ..... F01L 13/0005 123/198 F
5,107,803 A * 4/1992 Furnivall ..... F01L 1/181 123/90.16

(Continued)

FOREIGN PATENT DOCUMENTS

AT 514127 A1 10/2014
CN 202090976 U 12/2011

(Continued)

*Primary Examiner* — Patrick Hamo
*Assistant Examiner* — Wesley G Harris
(74) *Attorney, Agent, or Firm* — Weber Rosselli & Cannon LLP

(57) ABSTRACT

A valve train lever for actuating a valve of a reciprocating piston engine, in particular an internal combustion engine. The valve train lever comprises a lever arm, which is pivotally movable about a pin; a tapping element, which lies against or can be made to lie against a cam of a camshaft of the reciprocating piston engine; a coupling mechanism, by way of which the tapping element is coupled to the lever arm spring-elastically in a first state and rigidly in a second state; and an actuating element, which is connected to the lever arm and lies against or can be made to lie against a valve tappet of the valve.

11 Claims, 8 Drawing Sheets

(56) References Cited

U.S. PATENT DOCUMENTS

| | | | | |
|---|---|---|---|---|
| 5,584,268 | A * | 12/1996 | Natkin | F01L 1/2416 123/90.46 |
| 7,673,601 | B2 * | 3/2010 | Spath | F01L 1/146 123/90.15 |
| 8,763,576 | B2 * | 7/2014 | Kato | F01L 1/18 123/90.39 |
| 9,068,478 | B2 * | 6/2015 | Roberts | F01L 1/181 |
| 2008/0196680 | A1 * | 8/2008 | Janak | F02D 13/04 123/90.12 |
| 2015/0159521 | A1 * | 6/2015 | Baltrucki | F01L 1/24 123/90.12 |

FOREIGN PATENT DOCUMENTS

| | | | |
|---|---|---|---|
| CN | 102787880 | B | 11/2014 |
| JP | S57182205 | U | 11/1982 |
| JP | 2011185145 | A | 9/2011 |
| WO | 2014152944 | A1 | 9/2014 |

* cited by examiner

100

VALVE TRAIN LEVER

BACKGROUND

The internal combustion engine of a motor vehicle, in particular a commercial vehicle, may be used for supplying compressed air. For example, in coasting mode or engine braking mode, when the engine is not fired, it is used as a compressor for generating the compressed air. Furthermore, compressed gases can be removed from the combustion chamber of the internal combustion engine in defined operating cycles.

The laid-open patent application AT 514127 A1 describes a valve by way of which air is bled off when there is excessive pressure in the combustion chamber. A rocker lever is used for periodically opening the valve by a cam in defined operating cycles of the internal combustion engine. Integrated in the arm of the rocker lever on the cam side is a piston-cylinder unit, the piston of which interacts with the cam by way of a roller tappet. The rocker lever becomes effective when there is pressurization in the pressure space of the piston-cylinder unit. In the pressureless state of the piston-cylinder unit, the rocker lever is unactuated and the valve remains closed.

However, the previously known rocker lever does not assume a defined position in the pressureless state of the piston-cylinder unit. This is disadvantageous for the efficiency of the internal combustion engine and also for running noise and wear. In particular, the conventional rocker lever does not ensure continuous rolling contact between the roller tappet and the cam in the pressureless state.

A further disadvantage of the conventional rocker lever is its moment of inertia. In the pressurized state, the piston-cylinder unit must also transfer the forces of inertia of the rocker lever. Generally, this is not ensured by making the piston-cylinder unit larger, since that also has the effect of increasing the moment of inertia of the rocker lever. Also, the lubricating oil pressure of the internal combustion engine that is available for the pressurization is dictated by the operating state of the engine, and in idling mode may be below 1 bar.

SUMMARY

The present disclosure relates to a valve train lever for actuating a valve of a reciprocating piston engine, in particular an internal combustion engine. Disclosed in particular, without being restricted thereto, are a valve train lever for actuating a valve for removing compressed gases, in particular compressed air, from a combustion chamber of the internal combustion engine and an internal combustion engine equipped with such a valve train lever.

Consequently, the object is to provide a technique for actuating the valve that improves the efficiency, running noise and/or wear. A further or alternative object is to control the actuation of the valve by means of the oil pressure available for a reciprocating piston engine.

This object or these objects is/are achieved by a valve train lever for actuating a valve of a reciprocating piston engine, in particular an internal combustion engine, and a correspondingly equipped reciprocating piston engine according to the present disclosure.

According to one aspect of the present disclosure, a valve train lever comprises a lever arm, which is pivotally movable about a pin; a tapping element, which lies against or can be made to lie against a cam of a camshaft of the reciprocating piston engine; a coupling mechanism, by way of which the tapping element is coupled to the lever arm spring-elastically in a first state and rigidly in a second state; and an actuating element, which is connected to the lever arm and lies against or can be made to lie against a valve tappet of the valve.

The spring-elastic coupling in the first state allows the lever arm to assume a rest position, while the tapping element follows a contour of the cam because of the spring elasticity. The first state may also be referred to as the rest state of the valve train lever. In the second state, the valve of the reciprocating piston engine can be actuated because of the rigid coupling, in that the rigid coupling of the tapping element brings about the pivoting movement of the lever arm, and consequently the actuation by the actuating element.

Running noise and/or power losses can be reduced by the lever arm and the actuating element assuming a rest position in the first state. While the lever arm and the actuating element stay in the rest position in the first state, the tapping element can follow the cam contour because of the spring-elastic coupling to reduce power losses, running noises and/or wear.

The reciprocating piston engine may be an internal combustion engine. The reciprocating piston engine may be stationary or mobile.

The valve train lever may be formed as a rocker lever. The tapping element may be arranged at a first end of the rocker lever. The actuating element may be arranged at a second end of the rocker lever, opposite from the first end. On or in the lever arm, a pivot bearing for the pivoting movement of the rocker lever may be arranged between the first end and the second end. Alternatively, the valve train lever may be formed as a cam follower. The tapping element may be arranged at a first location of the cam follower. The actuating element may be arranged at a second location of the cam follower different from the first location. On or in the lever arm, a pivot bearing for the pivoting movement of the cam follower may be arranged. The first location may be arranged between the pivot bearing and the second location. Alternatively, the second location may be arranged between the pivot bearing and the first location.

The tapping element may be arranged movably in a transverse direction, transversely in relation to the lever arm, for example by a guide on the lever arm. Alternatively or additionally, the tapping element may be arranged immovably in a longitudinal direction different from the transverse direction (for example transversely in relation to the transverse direction, in particular parallel to the lever arm).

In the first state and in the second state, the tapping element may be prestressed toward the cam and/or lie against the cam. The coupling mechanism may comprise a pressure piston space and a pressure piston that is movable in the transverse direction in the pressure piston space. The pressure piston may delimit the pressure piston space.

At least in the second state, the pressure piston may interact with the tapping element. The pressure piston may interact with the tapping element in the second state in that, in the second state, the pressure piston lies against the tapping element, for example on a side of the tapping element that is facing the lever arm.

In the second state, the pressure piston space may be filled with a hydraulic fluid. The hydraulic fluid may be (at least substantially) incompressible. The hydraulic fluid may comprise oil, in particular lubricating oil of the reciprocating piston engine.

The tapping element may be prestressed in the transverse direction, for example away from the lever arm and/or toward the cam. The coupling mechanism may comprise a pressure spring supported on the lever arm. The pressure spring may prestress the tapping element in the transverse direction.

The pressure piston may interact with the tapping element in the first state and in the second state. The pressure piston may interact with the tapping element in the first state and the second state in that the pressure piston lies against the tapping element, for example on a side of the tapping element that is facing the lever arm. Alternatively, the pressure piston may be connected to the tapping element. The pressure piston and the tapping element may be immovable in relation to one another in the transverse direction.

The pressure spring may be arranged in the pressure piston space. The pressure spring may lie against the pressure piston. The pressure piston and the tapping element may together follow the contour of the cam in the first state and in the second state.

Alternatively or additionally, the pressure spring, or a further pressure spring, may lie against the tapping element.

The pressure piston may be prestressed in the transverse direction, for example toward the lever arm and/or away from the tapping element. The coupling mechanism may comprise a counterpressure spring supported on the tapping element. The counterpressure spring may be arranged between the tapping element and the pressure piston. The counterpressure spring may prestress the pressure piston in the transverse direction. Alternatively or additionally, the pressure piston may be prestressed by a tension spring that is fastened on the one hand to the lever arm and on the other hand to the pressure piston.

In the first state, the tapping element may be kept at a distance from the pressure piston in the transverse direction, for example because of the prestressing of the counterpressure spring and/or tension spring. Alternatively or additionally, in the first state the pressure piston may lie against a stop near to or proximal in relation to the lever and/or the pressure piston space may assume a minimum size.

In the second state, because of a volume and/or a pressure of the hydraulic fluid in the pressure piston space, the counterpressure spring may be contracted and/or the tension spring extended counter to the prestressing. In the second state, the pressure piston may lie against a stop far from or distal in relation to the lever and/or the pressure piston space may assume a maximum size.

The tapping element may follow the contour of the cam in the first state and in the second state. For example, in the first state only the tapping element may follow the contour of the cam. The pressure piston may be at rest in the first state. The pressure piston may respectively be at rest in relation to the lever arm in the first state and in the second state.

The tapping element may comprise a roller tappet. The roller tappet may comprise a cam run-on roller.

The valve train lever may also comprise a control unit for controlling the first state and the second state of the coupling mechanism. On the outlet side, the control unit may be in fluid connection with the pressure piston space. On the inlet side, the control unit may be in fluid connection with a control line.

The control unit may comprise a check valve and/or a hydraulic pressure intensification. The check valve may open in the direction of flow from the inlet side to the outlet side of the control unit and close in the opposite direction.

The control unit may comprise a control piston with an inlet-side effective surface and an outlet-side effective surface, for example for realizing the pressure intensification and/or for closing a relief line. The outlet-side effective surface may be smaller than the inlet-side effective surface. The hydraulic pressure intensification may intensify a pressure on the inlet side (control pressure) to a greater pressure on the outlet side, for example for pressurizing the pressure piston space in the second state. The hydraulic pressure intensification and the check valve may be connected in parallel.

The control unit may in the first state connect the outlet-side fluid connection to the pressure piston space to the relief line. The control unit may in the second state close the outlet-side fluid connection to the pressure piston space. The control unit may in the second state keep the outlet-side fluid connection to the pressure piston space closed against the greater pressure on the outlet side.

The control unit may optionally be in fluid connection on the inlet side with the oil circuit of the reciprocating piston engine by way of a solenoid valve. The solenoid valve may be arranged in the control line. With the solenoid valve closed, the control unit may bring about the first state. With the solenoid valve open, the control unit may bring about the second state.

The actuating element may optionally be in fluid connection with the oil circuit of the reciprocating piston engine (for example in the second state), for example by way of the same solenoid valve. The actuating element may comprise a ball-head connection and/or an actuating surface.

The tapping element, for example the roller tappet, may be in fluid connection with the oil circuit of the reciprocating piston engine permanently (for example in the first state and the second state).

The control unit may be arranged on the coupling mechanism or on a pivot bearing of the pivotally movable lever arm. The fluid connection or fluid connections between the control unit and the coupling mechanism may comprise bores in the lever arm.

Such a valve train lever may be used in a reciprocating piston engine, in particular an internal combustion engine or a compressor, for compressing a gas by selective actuation of the valve of the reciprocating piston engine.

According to a further aspect, a reciprocating piston engine, in particular an internal combustion engine, which comprises a valve train lever according to the first-mentioned aspect is provided. The reciprocating piston engine may comprise a valve for the periodic removal of a compressed gas from a compression space of the reciprocating piston engine, for example a combustion chamber of the internal combustion engine. The reciprocating piston engine may also comprise a camshaft with at least one cam for the selective actuation of the valve by way of the valve train lever. The actuation of the valve may be selective, by controlling the coupling mechanism of the valve train lever. In the first state, the actuation may not occur. In the second state, the actuation may be performed periodically on the basis of the cam.

Such a reciprocating piston engine, for example an internal combustion engine and/or a corresponding device for generating compressed air, may be stationary or used in a motor vehicle. A primary function of the internal combustion engine may be that of driving the motor vehicle. A secondary function of the internal combustion engine may be that of compressing the gas, for example generating the compressed air.

A further aspect concerns a motor vehicle with such an internal combustion engine. The motor vehicle may be a land vehicle, a watercraft or an aircraft. The motor vehicle may serve for transporting goods and/or for transporting people. In particular, the motor vehicle may be a commercial vehicle (for example a truck or a bus) or a passenger car. The compressed gas that is provided by the valve in the second state, for example the compressed air, may be fed to a braking system and/or an air spring of the motor vehicle.

Features described above can be realized in any combination. Further features and advantages of the present disclosure are described below with reference to the accompanying drawings, in which:

DETAILED DESCRIPTION

Figure 1:
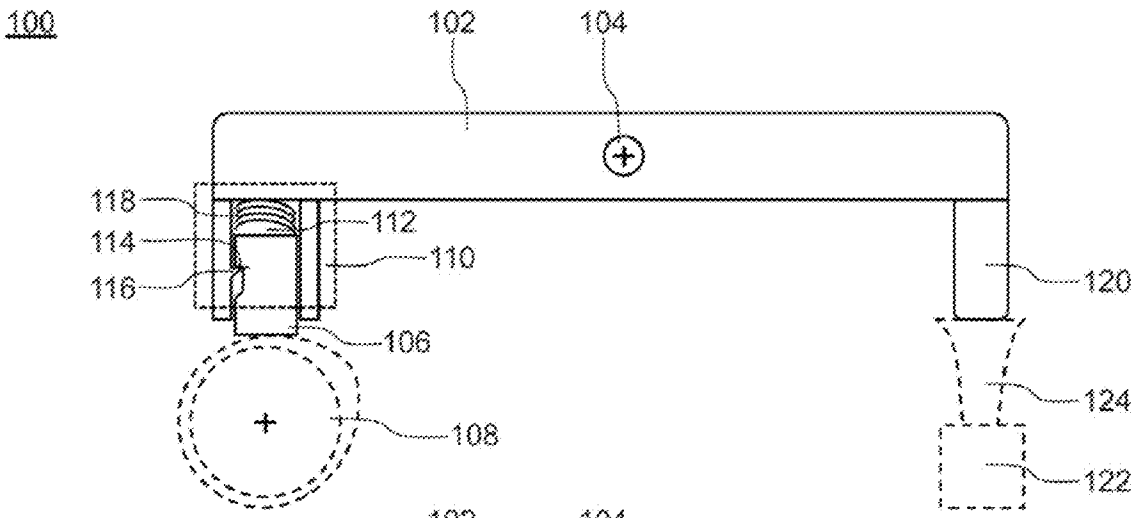
FIG. 1 shows a schematic representation of a first example of an embodiment of a valve train lever in a spring-elastic first state at a first point in time.

FIG. 1 schematically shows a first example of an embodiment of a valve train lever, denoted generally by the reference sign 100, for actuating a valve 122 of a reciprocating piston engine, in particular an internal combustion engine. The valve train lever 100 comprises a lever arm 102, which is pivotally movable about a pivot pin 104. At a first location of the lever arm 102, a tapping element 106 is arranged by way of a coupling mechanism 110 for interacting with a cam 108 of the reciprocating piston engine. The coupling mechanism 110 comprises a pressure piston space 112 for receiving a hydraulic fluid, for example lubricating oil. The tapping element 106 and/or a pressure piston arranged in the pressure piston space 112 has a longitudinal groove, in which a twist preventer 116 of the lever arm 102 engages. Optionally, the pressurization of the hydraulic fluid makes a lug 114 on the tapping element 106 or an element connected thereto (for example the pressure piston) lie against a stop (which is for example identical to the twist preventer 116) of the lever arm 102 or an element connected thereto. The coupling mechanism 110 also comprises a pressure spring 118, which on the one hand is supported on the lever arm 102 or an element connected thereto and on the other hand lies against the tapping element 106 or an element connected thereto (for example the pressure piston). The pressure spring 118 may in particular be a spiral spring or a wave spring.

In a first spring-elastic state of the coupling mechanism 110, the pressure piston space 112 is pressureless, so that the tapping element 106 follows the contour of the cam 108 because of the spring stressing of the spring 118. For this purpose, the spring stressing is set such that, with a maximum rotational speed, the force of inertia of the tapping element 106 is less than the spring stressing of the pressure spring 118.

Figure 2:
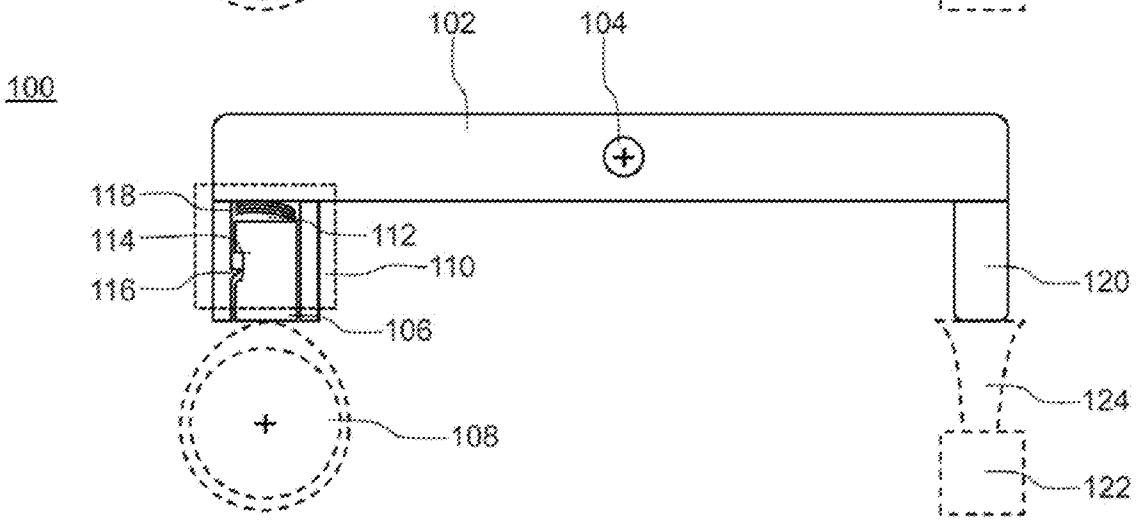
FIG. 2 shows a schematic representation of the first example of an embodiment of the valve train lever in the spring-elastic first state at a second point in time.

FIG. 1 shows the spring-elastic first state of the coupling mechanism 110 in the case of a first rotary position of the cam 108. FIG. 2 shows the first example of an embodiment in the same first state in the case of a second rotary position of the cam 108, in which the tip of the cam 108 guides the tapping element 106 to the lever arm 102, while reducing the size of the pressure piston space 112 and compressing the pressure spring 118. Consequently, the lever arm 102 and the actuating element 120 that is arranged at a second location of the lever arm 102 for actuating the valve 122 remain in a rest position.

In a first configuration, the rest position is maintained because of a prestressing of a valve tappet 124 of the valve 122 against the smaller spring stressing of the compressed spring 118. In a second configuration, the pivoting movement of the lever arm 102 about the pivot pin 104 in the first state is blocked, decelerated or damped. In a third configuration, the lever arm 112 is kept substantially in the rest position because of its moment of inertia with respect to the pivot pin 104, for example in that a resonant frequency or natural frequency of the spring-elastically coupled lever arm 102 is small in comparison with the rotational speed of the cam 108. The three configurations can be combined in pairs or completely.

Figure 3:
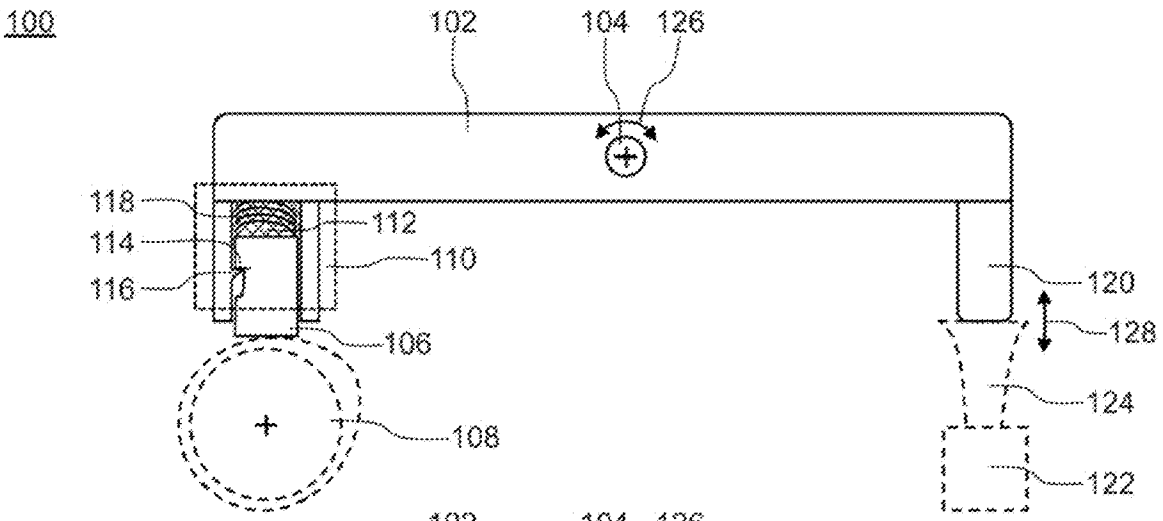
FIG. 3 shows a schematic representation of the first example of an embodiment of the valve train lever in a rigid second state at a first point in time.
Figure 4:
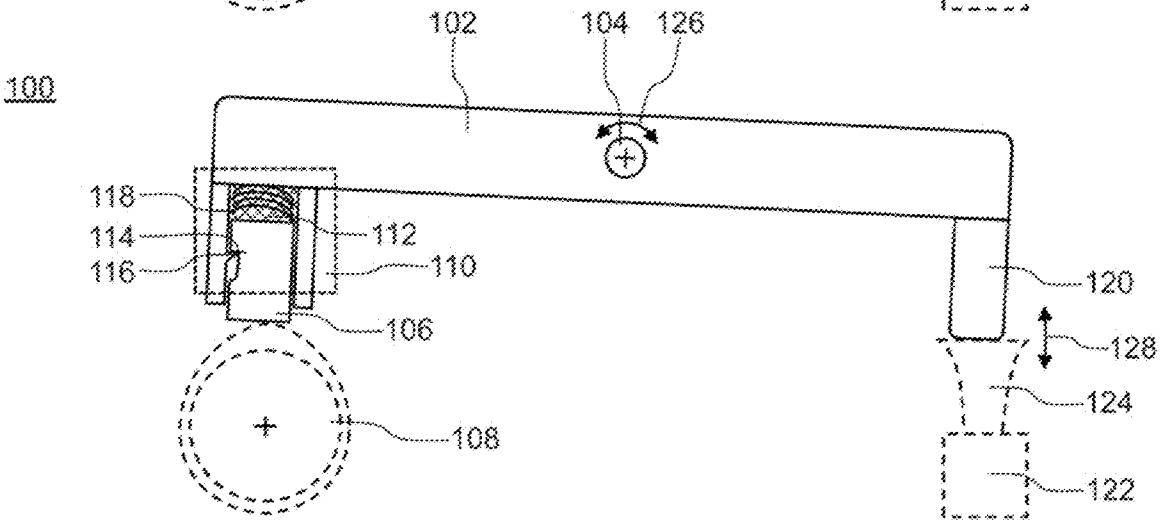
FIG. 4 shows a schematic representation of the first example of an embodiment of the valve train lever in the rigid second state at a second point in time.

In a second state, schematically shown in FIGS. 3 and 4, the pressure piston space 112 (optionally in its maximum extent with the lug 114 lying against the stop 116) is filled with the hydraulic fluid. In the second state of the coupling mechanism 110, the tapping element 106 is rigidly coupled to the lever arm 112 by way of the hydraulic fluid, for example in that a pressure of the hydraulic fluid is preset by way of a fluid connection into the pressure piston space 112 or in that a fluid outflow from the pressure piston space 112 is interrupted.

Because of the rigid coupling between the tapping element 106 and the lever arm 102 in the second state of the coupling mechanism 110, the movement of the tapping element 106 following the cam 108 is transferred by way of the lever arm 102 and the actuating element 120 to the valve tappet 124 of the valve 122. The pivoting movement 126 about the pivot pin 104 in the second state and the resultant actuation 128 of the valve 122 is shown in FIGS. 3 and 4. In the case of the first rotary position of the cam 108, shown in FIG. 3, the lever arm 102 is in a first pivoting position. In the case of the second rotary position of the cam 108, shown in FIG. 4, its tip interacts with the rigidly coupled tapping element and guides the lever arm 102 into a second pivoting position different from the first pivoting position.

In every example of an embodiment, the lever arm 102 may be formed as a rocker lever with the coupling mechanism 110 and the actuating element 120 respectively on different partial lever arms with respect to the pivot pin 104. Alternatively, the lever arm 102 may be formed as a cam follower, the coupling mechanism 110 and the actuating element 120 being arranged on the same side with respect to the pivot pin 104.

Figure 5:
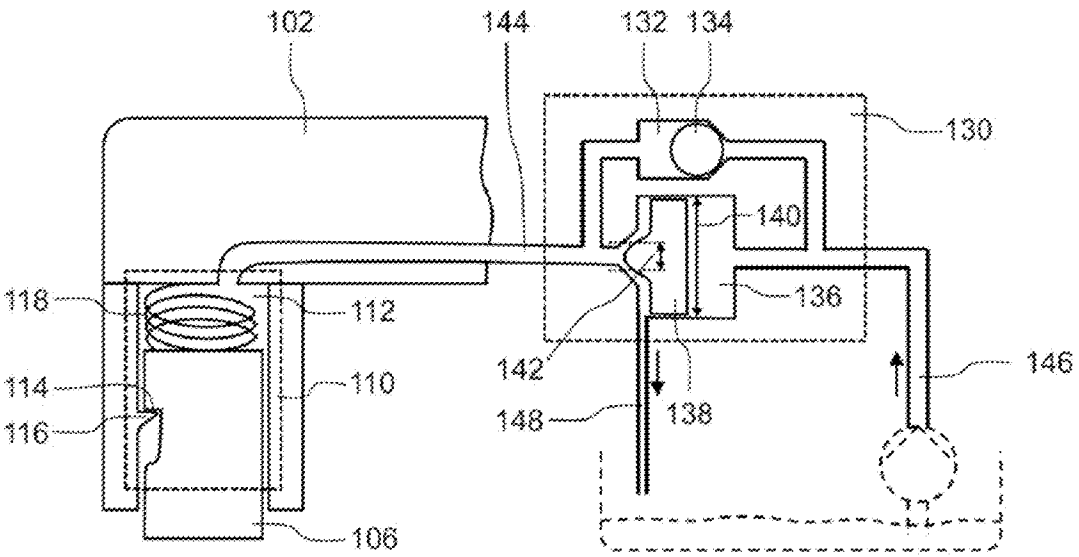
FIG. 5 shows a schematic representation of a second example of an embodiment of the valve train lever with a control unit, which can be combined with each example of an embodiment.

FIG. 5 schematically shows a second example of an embodiment of the valve train lever 100 with a control unit 130 for optionally controlling the first state and second state of the coupling mechanism 110. Equivalent or interchangeable features of the second example of an embodiment are provided with the same reference signs as in FIGS. 1 to 4 of the first example of an embodiment. The control unit 130 of the second example of an embodiment can be combined with every other example of an embodiment.

The control unit 130 comprises a check valve 132 with a closing element 134, which opens in the inflow direction to the pressure piston chamber 112 and closes in the outflow direction from the pressure piston chamber 112. The control unit 130 also comprises a control piston space 136 (for example in a cylinder), in which a control piston 138 is arranged longitudinally movably. With an inlet-side effective surface 140, the control piston 138 delimits the control piston space 136. An outlet side of the control piston 138, opposite from the inlet-side effective surface 140, is in fluid exchange with the pressure piston space 112 by way of a fluid connection 144. On the outlet side, the control piston 138, or a closing element lying against the control piston 138, is designed to close the cross section of a valve seat by way of an outlet-side effective surface 142.

The inlet-side effective surface 140 (for example with cross-sectional area $A_{in}$) is greater than the outlet-side effective surface 142 (for example with cross-sectional area $A_{out}$). If the inlet-side effective surface 140 is pressurized by a control line 146 in fluid connection with the control piston space 136 (for example with a control pressure $p_{control}$), the force of the control piston 138 that is brought about by the control pressure in the longitudinal direction of movement thereof (for example the force $A_{in} \cdot p_{control}$ corresponds to a greater closing pressure $p_{close}$ at the outlet-side effective surface 142 (for example a closing pressure greater in the ratio $A_{in}/A_{out}$ of the inlet-side effective surface 140 to the outlet-side effective surface 142).

By way of the check valve 132, which is likewise connected on the inlet side to the control line 146, the pressure piston space 112 can be filled with hydraulic fluid during the transition from the first state to the second state of the coupling mechanism 110. A control pressure $p_{control}$ in the control line 146 is adequate to maintain by means of the control piston 138 a closing pressure $p_{close}=p_{control} \cdot A_{in}/A_{out}$ in the pressure piston chamber 112 greater in the ratio of effective surfaces 140 and 142 for the rigid coupling of the tapping element 106.

Without pressurization of the control piston space 136 by way of the control line 146, the control piston 138 assumes an open position. In the open position, the outlet-side fluid connection 144 between the control unit 130 and the pressure piston space 112 is in fluid connection with a relief line 148 for the transition from the second state to the first state of the coupling mechanism 110.

In the case of the example of an embodiment of the control unit 130 shown in FIG. 5, the check valve 132 and the control piston 138 are respectively in fluid connection on the inlet side and outlet side, i.e. the check valve 132 and the control piston 138 in the control piston space 136 are connected in parallel. The inlet side of the control unit 130 is in fluid connection with the control line 146. The outlet side of the control unit 130 is connected by way of a single fluid connection 144 to the pressure piston space 112. In a variant of the control unit 130, which can be used in every example of an embodiment, the check valve 132 and the control piston 138 are connected on the outlet side to the pressure piston space 112 by way of separate fluid connections.

The control line 146 is preferably connected to an existing lubricating oil supply of the internal combustion engine by way of a solenoid valve for controlling the first state and the second state of the coupling mechanism 110.

Figure 6:
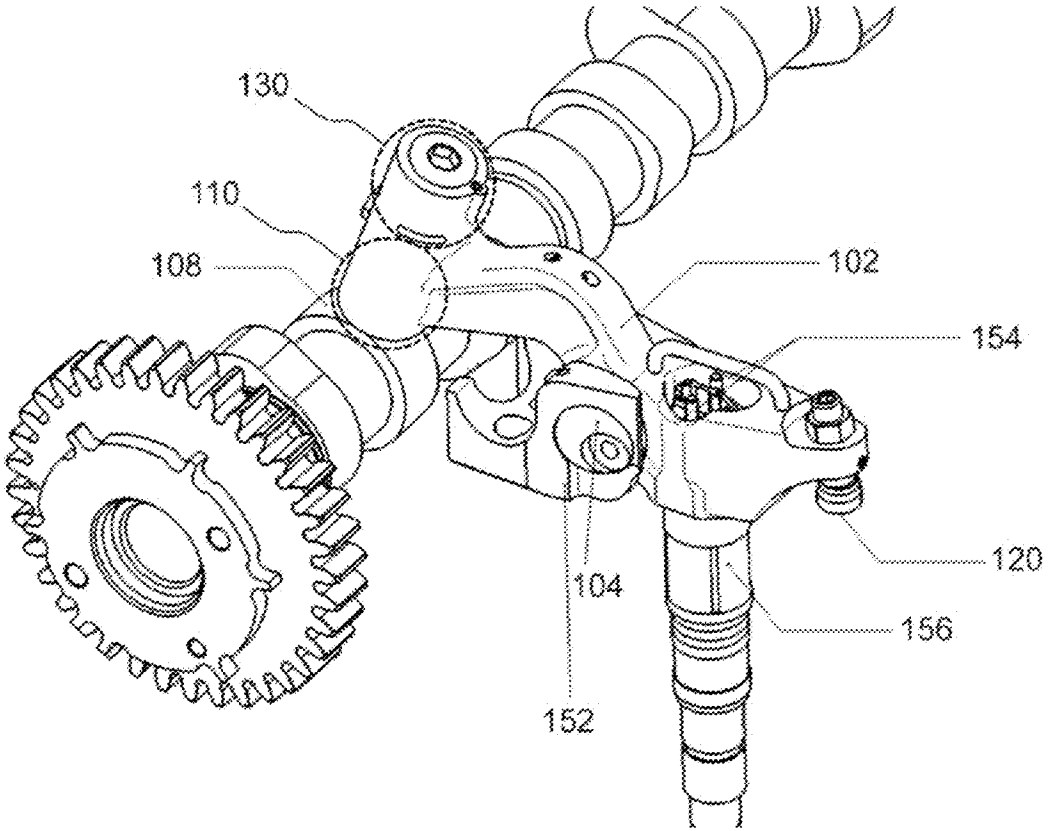
FIG. 6 shows a schematic perspective representation of a third example of an embodiment of the valve train lever, in which the control unit is arranged at the tapping element.

FIG. 6 shows a perspective representation of a third example of an embodiment of the valve train lever 100. In the third example of an embodiment, shown in FIG. 6, the control unit 130 is arranged on the coupling mechanism 110. Preferably, the control unit 130 is arranged on the side of the tapping element 106 that is facing away from the cam 108 in the longitudinal direction of movement (i.e. the transverse direction in relation to the lever arm 102). In particular, the longitudinal direction of movement of the tapping element 106 and the longitudinal direction of movement of the control piston 138 may be coaxial and/or the fluid connections between the control piston 138 and the pressure piston space 112 may be realized by a bore within a common housing of the coupling mechanism 110 and the control unit 130.

The pivot pin 104 is mounted pivotally movably by way of a bearing block 152 screwed on the cylinder head of the internal combustion engine. The control line 146 is led through bores within the lever arm 102 and, by way of the pivot pin 104, is in fluid connection with the solenoid valve for controlling the first state and second state of the coupling mechanism 110 independently of the pivoting position of the lever arm 102.

In a first variant, shown in FIG. 6, the lever arm 102 between the pivot pin 104 and the actuating element 120 has a double web 154. Between the webs 154 there is an installation space for connections of an injection nozzle 156 of the internal combustion engine. In a second variant, which can be realized in the case of every example of an embodiment, the lever arm 102 is made to extend over the injection nozzle 156.

Figure 7:
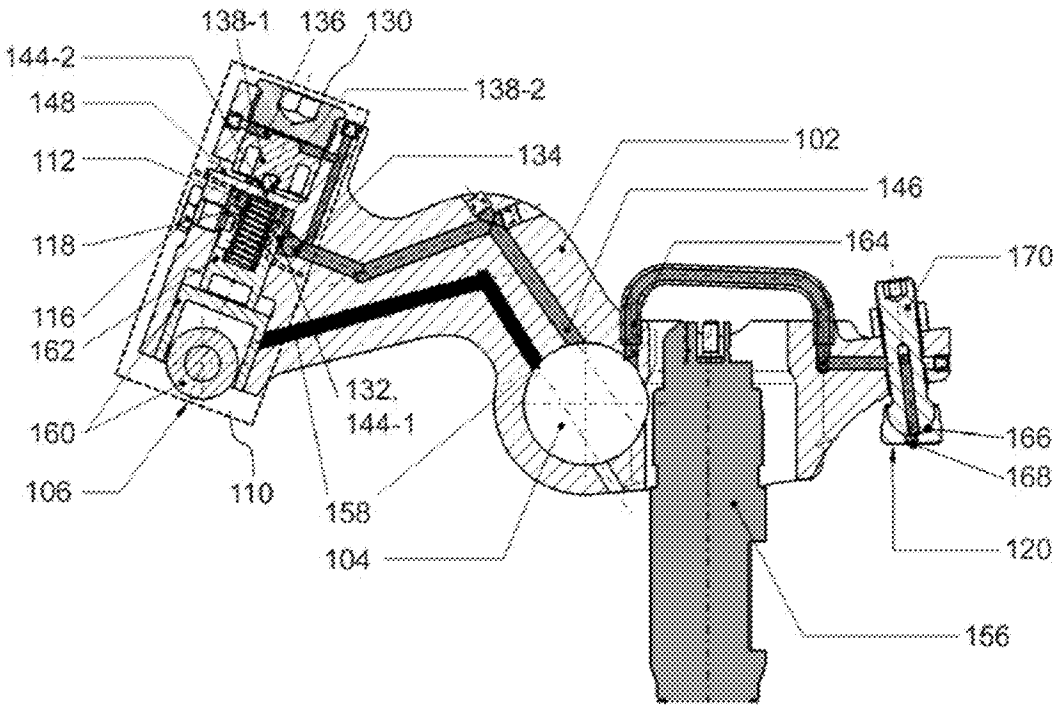
FIG. 7 shows a schematic sectional representation of the third example of an embodiment in a pivoting plane.

FIG. 7 schematically shows a cross section of the third example of an embodiment of the valve train lever 100 in the pivoting plane of the pivot pin 104. Oil from the engine oil circuit is constantly fed to the rocker lever 102 by way of a bore of a permanent oil pressure line 158. During operation of the engine, the permanent oil pressure line 158 is always under an oil pressure, in order to lubricate a roller tappet 160 of the tapping element 106 during its upward and downward movement on the cam 108. The control line 146, realized by bores in the rocker lever 102, is likewise supplied with the oil from the engine circuit, preferably by way of a solenoid valve connected upstream, which optionally feeds oil by way of the pivot pin 104 for controlling the first state and second state of the coupling mechanism 110.

The first state and second state of the coupling mechanism 110 may also be respectively referred to as the switched-off state and switched-on state with regard to the function of the valve 122 for removing the compressed gas (for example compressed air). In the switched-on state, there is therefore oil pressure in the bore of the control line 146. The oil pressure has the effect of pressing a ball as a closing element 134 out of the check valve 132, formed by a depression, and allows the oil to flow by way of a short bore as a fluid connection 144-1 into the pressure control space 112. At the same time, the oil flows into the control piston space 136 and presses the control piston 138-1 (which defines the inlet-side effective surface) against a ball as a closing element 138-2 with the outlet-side effective surface. The closing element 138-2 closes the fluid connection 144-2 between the pressure piston space 112 and the relief line 148. Consequently, the pressure piston space 112 is a closed space and a pressure piston 162 of the tapping element 106 is pressed away from the lever arm 102 toward the cam 108. The pressure piston 162 always lies against the roller tappet 160.

The twist preventer 116 formed by a projecting screw shank comprises a projection which engages in a longitudinal groove on the pressure piston 162. Optionally, the projection also serves as a stop, the upper end of the groove forming the lug 114.

Consequently, the roller tappet 160 lies on the cam 108 in rigid coupling with the lever arm 102, and because of the rigid coupling the entire rocker lever 102 is moved by the cam 108 for the actuation 128 of the valve 122.

At the same time, preferably as a result of fluid connection with the control line 146, there is also oil pressure in a controlled oil pressure line 164 for supplying the actuating element 120 with lubricating oil. The actuating element 120 comprises a ball-head connection 166 and an actuating surface 168, which are respectively wetted with lubricating oil by way of the controlled oil pressure line 164. In the controlled oil pressure line 164, oil is only delivered if the coupling mechanism 110 is in the second state, that is to say the rocker lever 102 is in the switched-on state, with the solenoid valve open.

In the first state (i.e. the switched-off state), the supply of oil into the control line 146 (and the controlled oil pressure line 164 in fluid connection therewith) is interrupted by way of the solenoid valve. Consequently, there is no longer any pressure on the control piston 138-1 and the fluid connection 144-2 formed as a relief bore is no longer closed by way of the control piston 138-1 and its closing element 138-2 at the outlet-side effective surface 142. The open position of the closing element 138-2 brings the fluid connection 144-2 into connection with the relief line 148. The roller tappet 160 is pressed together with the pressure piston 162 toward the lever arm 102 because of the actuation by the cam 108. The pressure piston 162 forces oil out of the pressure piston space 112 outward by way of the fluid connection 144-2 into the relief line 148. Since there is no longer any pressure in the pressure piston space 112 and pressure no longer acts on the tapping element 106 by way of the pressure piston 162, the roller tappet 160 of the tapping element 106 is then only pressed by way of the pressure spring 118 onto the cam 108 according to the spring-elastic first state of the coupling mechanism 110. That is to say that the roller tappet 160 and the pressure piston 162 of the tapping element 106 move up and down, but not the entire valve train lever 100, for example because the spring force of the pressure spring 118 is smaller than the compressive force of a valve spring of the valve 122, which interacts with the actuating element 120 on the opposite side of the lever arm 102.

The actuating element may also comprise a setting screw 170. Alternatively or additionally, a valve clearance of the valve 122 may be set by the fluid volume in the pressure piston space 112 in the second state.

Figure 8:
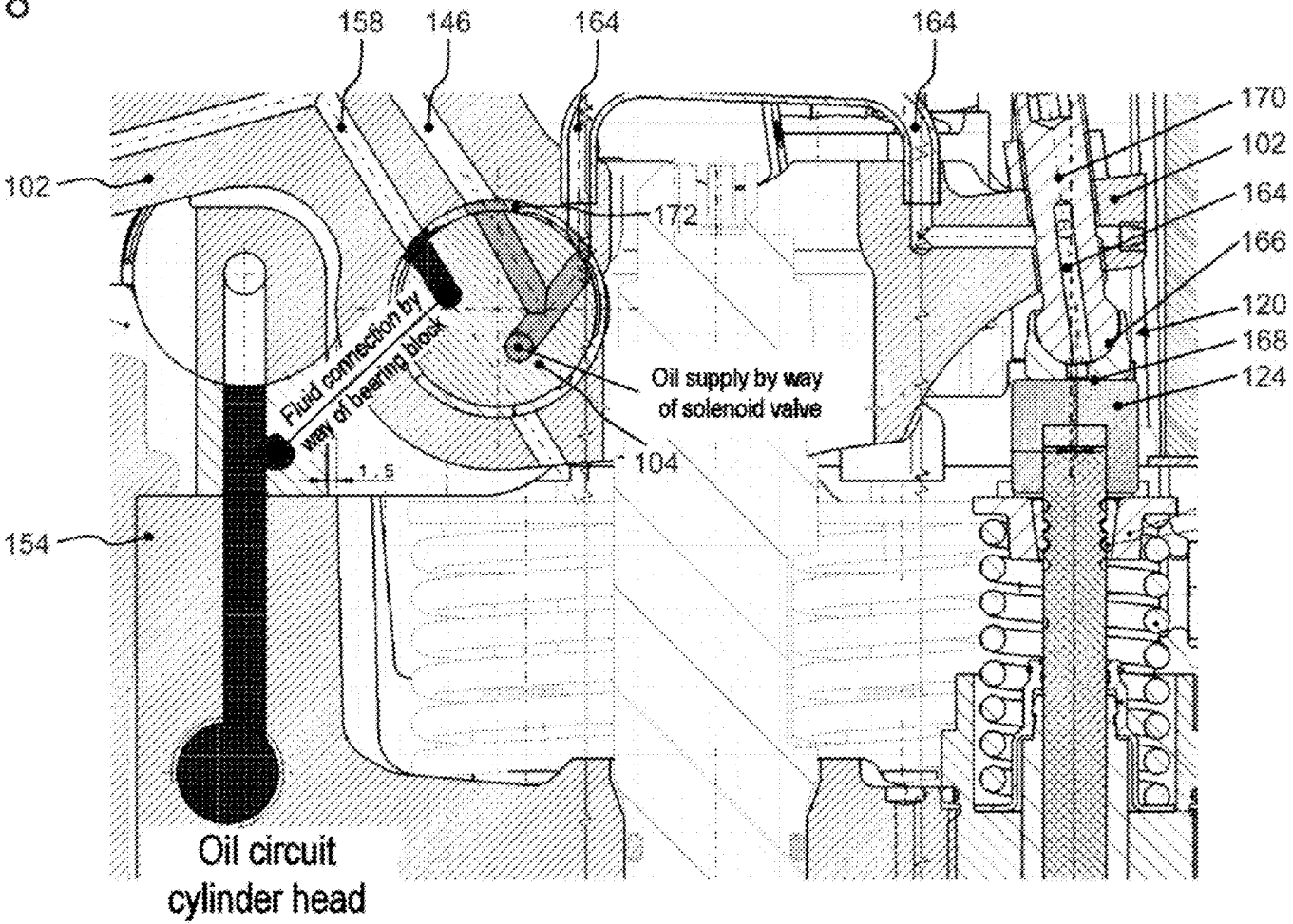
FIG. 8 shows an enlarged detail of the sectional representation of the third example of an embodiment in the fitted state.

FIG. 8 shows an enlarged detail of the cross section of FIG. 7. A bearing bush 172 is arranged between the pivot pin 104 and a bore in the lever arm 102. By way of the bearing bush 172, in every example of an embodiment oil can be fed into the oil pressure line 158 (for example permanently during the operation of the internal combustion engine) and/or (optionally, for example for controlling the state of the coupling mechanism 110) into the control line 146. In every pivoting position of the lever arm 102, azimuthal slits in the bearing bush 172 on the lateral surface of the pivot pin 104 connect ends of the bores in the pivot pin 104 to the corresponding ends of the bores in the lever arm 102. In the third example of an embodiment, shown in FIG. 8, the control line 146 and the controlled oil pressure line 164 are in fluid connection by way of bores in the pivot pin 104, so that the actuating element 120 is supplied with lubricating oil precisely when the coupling mechanism 110 is in the rigid second state.

Figure 9:
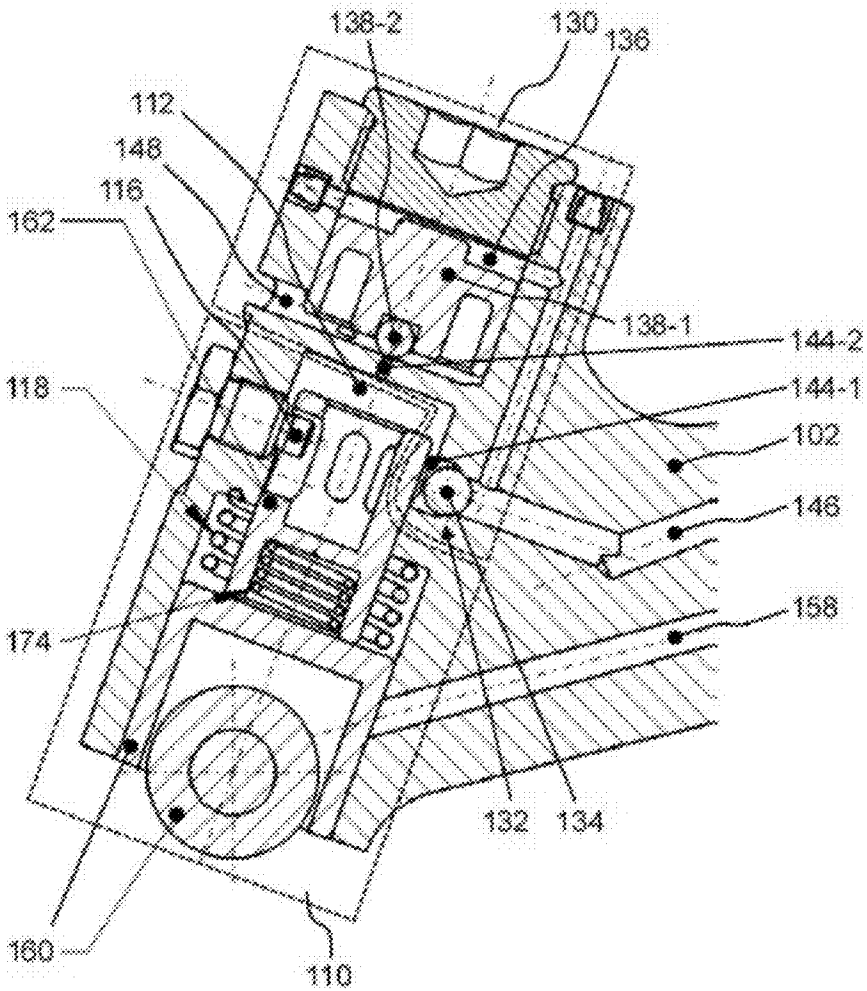
FIG. 9 shows a schematic sectional representation of a fourth example of an embodiment of the valve train lever in the pivoting plane.

FIG. 9 shows a schematic cross section in the pivoting plane of a fourth example of an embodiment of the valve train lever 100. The fourth example of an embodiment differs from the previous examples of embodiments in the configuration of the coupling mechanism 110. The coupling mechanism 110 of the fourth example of an embodiment can be used in combination with every previous example of an embodiment. Features that coincide or can be interchanged with the previous examples of embodiments are provided with the same reference signs in FIG. 9.

The pressure spring 118 is supported on the lever arm 102 and, instead of against the pressure piston 162 of the tapping element 106, lies against the roller tappet 160 of the tapping element 106. An additional counterpressure spring 174 constantly presses the pressure piston 162 upward (i.e. toward the lever arm 102) in the first state of the coupling mechanism 110, that is to say in the switched-off mode of the valve train lever 100. The pressure piston 162 no longer moves up and down in the first state, and consequently does not cause unwanted pumping of the oil.

In the fourth example of an embodiment, shown in FIG. 9, the counterpressure spring 174 is supported on the pressure piston 162 and lies against the roller tappet 160. In an alternative configuration of the coupling mechanism, the lever arm 102 and the pressure piston 162 are connected to a tension spring. As a result, in the first state the pressure piston 162 does not lie against the roller tappet 160 and is pressed toward the lever arm 102 (i.e. to a minimum volume of the pressure piston space 112). The spring stressing of the counterpressure spring 174 of the pressure piston 162 is (in every position of the pressure piston 162 and of the roller tappet 160) at most so great that, with pressure in the control line 146 and consequently in the pressure piston space 112 (for example oil pressure at 1 bar), the pressure piston 162 is pressed toward the roller tappet 160 and lies against it for the rigid coupling in the second state of the coupling mechanism 110.

In all of the examples of embodiments, the pressure spring 118 ensures that the roller tappet 160 lies on the cam 108 both in the first state and in the second state. The spring stressing of the pressure spring 118 for the roller tappet 160 is at least so great that the mass of the roller tappet 160 follows the cam 108 at the maximum rotational speed. As a result, the efficiency is improved, and wear and running noises are reduced.

The coupling mechanism 110 of the fourth example of an embodiment has the advantage that the pressure piston 162 in the first state of the coupling mechanism 110 (i.e. in the switched-off mode of the valve train lever 110) does not constantly follow the up and down movement of the roller tappet 160 and unnecessarily pump oil. As a result, the efficiency is improved.

Figure 10:
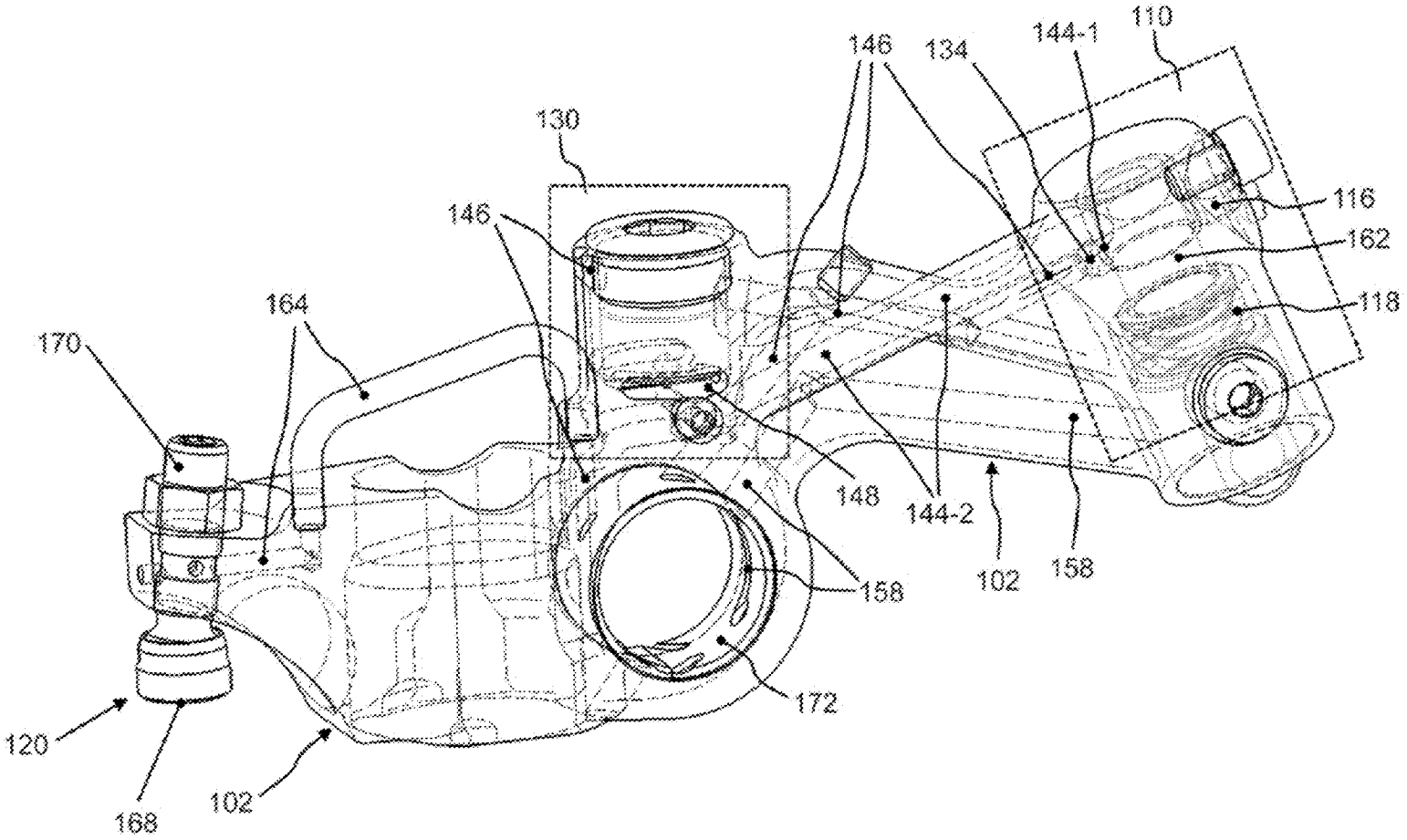
FIG. 10 shows a schematic perspective representation of a fifth example of an embodiment of the valve train lever in which the control unit is arranged near to the axis.

FIG. 10 shows a perspective view of the fifth example of an embodiment of the valve train lever 100. The fifth example of an embodiment differs from the previous examples of embodiments in the arrangement of the control unit 130. The arrangement of the control unit 130 of the fifth example of an embodiment can be implemented appropriately in the case of every previous example of an embodiment. Features that coincide or can be interchanged with the previous examples of embodiments are provided with the same reference signs in FIG. 10.

In the fifth example of an embodiment, the control unit 130 is not arranged in the extended axis over the pressure piston 162 but at some other (in principle any location, for example on the lever arm 102). The control unit 130 and the coupling mechanism 110 may (for example as in the second example of an embodiment of FIG. 5) be connected by way of a fluid connection 144 or (for example as in the fifth example of an embodiment of FIG. 10) by way of two fluid connections 144-1 and 144-2.

An advantageous location on the lever arm 102 for arranging the control unit 130 is at the pivot pin 104 (for example over the pivot pin 104). The fifth example of an embodiment of FIG. 10 shows an example of this arrangement. The arrangement at the pivot pin 104 results in a smaller overall height. Furthermore, the mass inertia (i.e. the moment of inertia of the valve train lever 100 with respect to the pivot pin 102) is improved. While in the case of the fifth example of an embodiment, shown in FIG. 10, the orientation of the control unit 130 with respect to the direction of movement of the control piston 138 is perpendicular to the lever arm 102, parallel to the direction of movement of the valve tappet 124 and/or parallel to the transverse direction of the lever arm, the control unit 130 may also be arranged parallel to the lever arm 102, perpendicularly to the direction of movement of the valve tappet 124 or obliquely thereto. The basic functional principle does not change, only the oil bores are adapted to the location and/or orientation of the control unit 130.

Although the present disclosure has been described with reference to exemplary examples of embodiments, it is evident to a person skilled in the art that various changes may be made and equivalents may be substituted. In addition, many modifications may be made to adapt a particular situation or a particular drive to the teaching of the present disclosure. Consequently, the present disclosure is not restricted to the disclosed examples of embodiments and implementations but comprises all examples of embodiments that come within the scope of the appended patent claims.

LIST OF REFERENCE SIGNS

100 Valve train lever
102 Lever arm
104 Pivot pin
106 Tapping element
108 Cam
110 Coupling mechanism
112 Pressure piston space
114 Lug
116 Twist preventer, optional stop
118 Pressure spring
120 Actuating element
122 Valve in the cylinder head
124 Valve tappet
126 Pivoting movement
128 Actuating movement
130 Control unit
132 Check valve
134 Closing element
136 Control piston space
138 Control piston
140 Inlet-side effective surface
142 Outlet-side effective surface
144 Fluid connection between control unit and coupling mechanism
146 Control line
148 Relief line
152 Bearing block
154 Double web
156 Injection nozzle
158 Permanent oil pressure line
160 Roller tappet
162 Pressure piston
164 Controlled oil pressure line
166 Ball-head connection
168 Actuating surface
170 Setting screw
172 Bearing bush
174 Counterpressure spring

We claim:

1. A valve train lever for actuating a valve of a reciprocating piston engine, comprising:

a lever arm, which is pivotally movable about a pin;

a tapping element, which lies against or can be made to lie against a cam of a camshaft of the reciprocating piston engine, wherein the tapping element is arranged movably in a transverse direction, transversely in relation to the lever arm;

a coupling mechanism, by way of which the tapping element is coupled to the lever arm spring-elastically in a first state and rigidly in a second state, wherein the coupling mechanism comprises a pressure piston space and a pressure piston that is movable in the transverse direction and delimits the pressure piston space;

an actuating element, which is connected to the lever arm and lies against or can be made to lie against a valve tappet of the valve; and a control unit for controlling the first state and the second state of the coupling mechanism, wherein the control unit on an outlet side is in fluid connection with the pressure piston space wherein the control unit on an inlet side is in fluid connection with a control line, wherein the control unit for realizing a pressure intensification comprises a control piston with an inlet-side effective surface and an outlet-side effective surface, the outlet side effective surface is smaller than the inlet-side effective surface, wherein the control unit in a first state connects the outlet side in fluid connection with the pressure piston space to a relief line.

2. The valve train lever according to claim 1, wherein, at least in the second state, the pressure piston interacts with the tapping element and, in the second state, the pressure piston space is filled with a hydraulic fluid.

3. The valve train lever according to claim 1, wherein the coupling mechanism comprises a pressure spring, which is supported on the lever arm and prestresses the tapping element in the transverse direction.

4. The valve train lever according to claim 3, wherein the pressure piston interacts with the tapping element in the first state and in the second state, and the pressure spring is arranged in the pressure piston space and lies against the pressure piston.

5. The valve train lever according to claim 3, wherein the pressure spring lies against the tapping element.

6. The valve train lever according to claim 5, wherein the coupling mechanism comprises a counterpressure spring, which is supported on the tapping element and prestesses the pressure piston in the transverse direction, and, in the first state, the tapping element is kept at a distance from the pressure piston in the transverse direction.

7. The valve train lever according to claim 1, wherein the tapping element comprises a roller tappet.

8. The valve train lever according to claim 1, wherein a longitudinal direction of movement of the tapping element and a longitudinal direction of movement of the control piston are coaxial.

9. A reciprocating piston engine, in particular an internal combustion engine, comprising:

a valve train lever for actuating a valve of the reciprocating piston engine, the valve train lever including, a lever arm, which is pivotally movable about a pin;

a tapping element, which lies against or can be made to lie against a cam of a camshaft of the reciprocating piston engine, wherein the tapping element is arranged movably in a transverse direction, transversely in relation to the lever arm;

a coupling mechanism, by way of which the tapping element is coupled to the lever arm spring-elastically in a first state and rigidly in a second state, wherein the coupling mechanism comprises a pressure piston space and a pressure piston that is movable in the transverse direction and delimits the pressure piston space;

an actuating element, which is connected to the lever arm and lies against or can be made to lie against a valve tappet of the valve; and a control unit for controlling the first state and the second state of the coupling mechanism, wherein the control unit on an outlet side is in fluid connection with the pressure piston space wherein the control unit on an inlet side is in fluid connection with a control line, wherein the control unit for realizing a pressure intensification comprises a control piston with an inlet-side effective surface and an outlet-side effective surface, the outlet side effective surface is smaller than the inlet-side effective surface, wherein the control unit in a first state connects the outlet side in fluid connection with the pressure piston space to a relief line.

10. A reciprocating piston engine according to claim 9, wherein the control unit is in fluid connection on an inlet side with an oil circuit of the reciprocating piston engine by way of a solenoid valve.

11. A motor vehicle, in particular a commercial vehicle, with an internal combustion engine comprising:

a valve train lever for actuating a valve of a reciprocating piston engine, the valve train lever including, a lever arm, which is pivotally movable about a pin;

a tapping element, which lies against or can be made to lie against a cam of a camshaft of the reciprocating piston engine, wherein the tapping element is arranged movably in a transverse direction, transversely in relation to the lever arm;

a coupling mechanism, by way of which the tapping element is coupled to the lever arm spring-elastically in a first state and rigidly in a second state, wherein the coupling mechanism comprises a pressure piston space and a pressure piston that is movable in the transverse direction and delimits the pressure piston space;

an actuating element, which is connected to the lever arm and lies against or can be made to lie against a valve tappet of the valve; and a control unit for controlling the first state and the second state of the coupling mechanism, wherein the control unit on an outlet side is in fluid connection with the pressure piston space wherein the control unit on an inlet side is in fluid connection with a control line, wherein the control unit for realizing a pressure intensification comprises a control piston with an inlet-side effective surface and an outlet-side effective surface, the outlet side effective surface is smaller than the inlet-side effective surface, wherein the control unit in a first state connects the outlet side in fluid connection with the pressure piston space to a relief line.

* * * * *